US007491081B2

(12) United States Patent
Fehling et al.

(10) Patent No.: US 7,491,081 B2
(45) Date of Patent: Feb. 17, 2009

(54) ELECTRICAL CONNECTOR HAVING PLUG AND SOCKET COMPONENTS

(75) Inventors: Stefan Fehling, Lage (DE); Jens Oesterhaus, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/809,178

(22) Filed: May 31, 2007

(65) Prior Publication Data

US 2007/0293076 A1 Dec. 20, 2007

(30) Foreign Application Priority Data

Jun. 3, 2006 (DE) ..... 20 2006 008 838 U

(51) Int. Cl.
*H01R 13/62* (2006.01)

(52) U.S. Cl. ..... 439/320; 439/277

(58) Field of Classification Search ..... 439/277, 439/320, 321–323
See application file for complete search history.

(56) References Cited

U.S. PATENT DOCUMENTS

| | | | | |
|---|---|---|---|---|
| 3,739,076 | A * | 6/1973 | Schwartz | 174/78 |
| 3,763,460 | A * | 10/1973 | Hatschek et al. | 439/277 |
| 4,540,230 | A * | 9/1985 | Iversen et al. | 439/277 |
| 5,785,544 | A * | 7/1998 | Linden et al. | 439/278 |
| 5,857,865 | A * | 1/1999 | Shimirak et al. | 439/277 |
| 6,439,899 | B1 * | 8/2002 | Muzslay et al. | 439/98 |
| 6,957,970 | B2 * | 10/2005 | Weigel et al. | 439/320 |
| 7,033,193 | B2 * | 4/2006 | Higgins et al. | 439/277 |
| 7,207,820 | B1 * | 4/2007 | Montena | 439/275 |

FOREIGN PATENT DOCUMENTS

| | | |
|---|---|---|
| DE | 11 80 440 A | 10/1964 |
| DE | 20 34 948 A | 2/1971 |
| EP | 14 24 750 A1 | 9/1937 |

* cited by examiner

*Primary Examiner*—Gary F. Paumen
(74) *Attorney, Agent, or Firm*—Lawrence E. Laubscher, Sr.; Lawrence E. Laubscher, Jr.

(57) ABSTRACT

An electrical connector arrangement includes a socket having a central body portion supporting a plurality of female contacts, and a tubular outer portion extending in concentric spaced relation about the body portion to define a groove. A plug component having a cylindrical body portion including a plurality of male contacts includes a tubular end portion that extends axially within the groove to connect the male and female contacts, respectively. A fastening sleeve is rotatably mounted on the plug between the outer surface thereof and the socket outer portion, whereby external screw threads on the sleeve engage internal threads on the socket tubular portion, thereby to fasten together the plug and socket components. In order to reduce the assembly time, the number and length of the screw threads on one of the sleeve and socket components is less than the number and length of the screw threads of the other component.

9 Claims, 2 Drawing Sheets

ELECTRICAL CONNECTOR HAVING PLUG AND SOCKET COMPONENTS

BACKGROUND OF THE INVENTION

1. Field of the Invention

A plug and socket connector arrangement includes a fastening sleeve rotatably mounted on the plug between the outer surface thereof and a concentrically arranged outer annular portion of the socket, whereby external screw threads on the sleeve engage internal threads on the socket annular portion, thereby to fasten together the plug and socket components. In order to reduce the assembly time, the number and length of the screw threads on one of the sleeve and socket components is less than the number and length of the screw threads of the other component.

2. Description of Related Art

Various types of plug and socket electrical connectors are well known in the prior art. On the one hand, cables can be connected directly together by plug and socket connectors. Furthermore, it is possible, depending on the model, to connect a number of cables by means of plugs to a distributor which electrically connects the cable conductors to various loads. In order to provide a secure connection in the area of the connecting locations, the plug part and the socket part may be secured together by a screw thread connection. In the simplest case, the typical plug parts are provided with a rotatable sleeve having an external screw thread. Such designs have the drawback that after bringing the plug and socket parts together, a time-consuming screwing operation is required to fasten two screw threads of relatively long length.

This requires an appreciable amount of time, especially during the automated production of products requiring a large number of screwing operations. The connections are arranged in close proximity, and this also contributes to the time delay and results in relatively laborious functions. Plug and socket components of the bayonet type were created that make it possible to introduce the plug part axially into the socket, and then to rotate the parts slightly to effect a final and axial fastening together of the parts.

Unfortunately, this results in the disadvantage that the prior art designs require a costly fabrication and processing of both the sleeve part as well as also the socket. Certain areas have no threads requiring the need for rotation, and only at the very last moment are the parts secured by angular torsion. In this case, if a connection were to be made to an internal screw thread, one cannot achieve any appreciable time advantage when compared to the known screwing procedures.

It has also been proposed that in place of the outer screw thread on the sleeve on the plug component, a metal tongue be provided that can be spread apart by spreading means, whereby the spreading means is actuated only when the sleeve part, with an axial motion, has been introduced into the corresponding component having an internal screw thread. This construction is subject to criticism because of its relatively complicated and costly structure.

The present invention was developed to avoid the above and other drawbacks of the known plug and socket connector arrangements.

SUMMARY OF THE INVENTION

Accordingly, a primary object of the present invention is to provide a plug and socket connector arrangement including a fastening sleeve mounted for rotation concentrically about the plug, said sleeve having on its outer circumference external thread means arranged for threaded engagement with corresponding internal thread means carried by a concentrically spaced outer annular portion of the socket member, characterized that one of the internal and external thread means has fewer turns and less thread length than the other, thereby to reduce the number of turns required to fasten the sleeve to the socket.

According to the preferred embodiment of the invention, the screw thread means having the fewer turns and the shorter thread length comprises the external thread means on the sleeve. Preferably the thread length of the shorter screw thread means is less than about 30% of the length of the larger screw thread means. The shorter screw thread means has no more than three, and preferably no more than two, screw thread turns. In a second embodiment, the shorter screw thread means with the fewer number of turns is provided on the inner surface of the annular outer portion of the socket. This arrangement is particularly advantageous where the internal screw thread means is designed in accordance with the requirements of an M-standard plug—especially, the M5, M6, M8, or M12 standard plug—where five or more screw thread turns are customary.

In accordance with another object of the invention, the number of rotations for making the screw connection is thus reduced relative to the number of rotations required for the prior art connectors including a pair of cooperating screw means each having a relatively long length. The connector of the present invention may be produced without any major or radical change in the connector design. The plug connections can be assembled quickly and securely, and moreover in installation situations that are difficult to access when the connections are closely positioned together.

A further object of the invention is to provide a connector of the type described above, wherein the screw thread means on the sleeve is spaced from the extremity of the introduction end of the sleeve. The introductory end of the sleeve is smooth and devoid of screw threads, thereby to permit axial insertion of the plug end into the annular socket groove prior to rotation of the sleeve relative to the plug. A resilient O-ring may be mounted in the bottom of the annular groove in the socket that receives the introductory tubular end portion of the plug, which O-ring, upon rotation of the sleeve, is compressed between the groove bottom and the outer flange portion of the plug body that retains the sleeve on the plug.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1B:
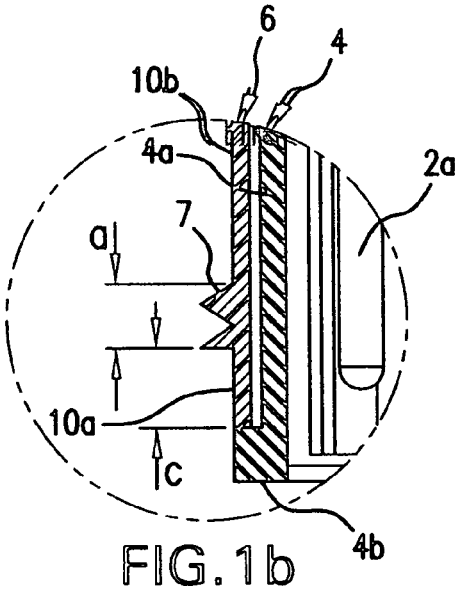
FIG. 1*b* is a detailed view of the plug component of FIG. 1*a;*
Figure 1A:
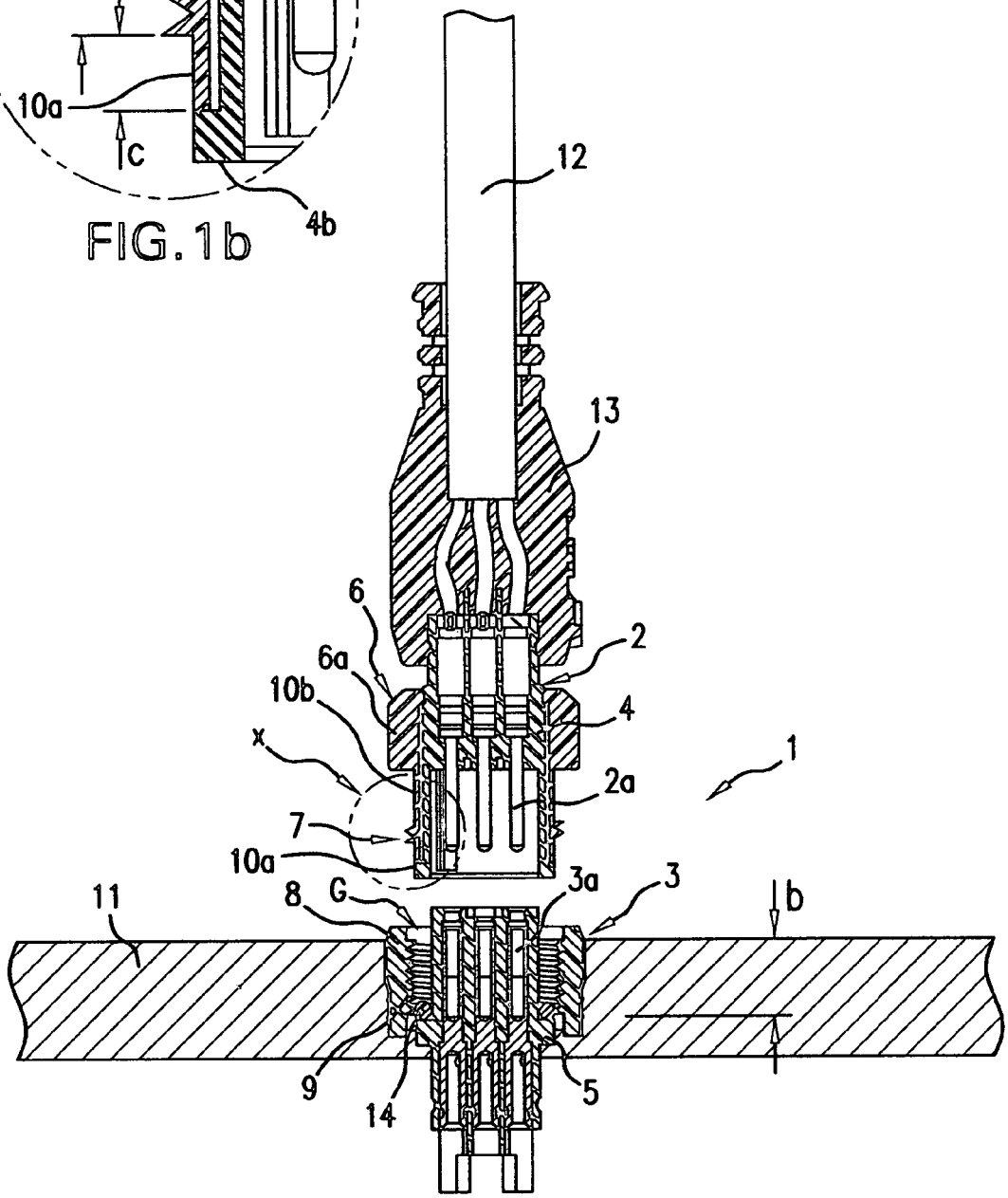
FIG. 1*a* is a sectional view illustrating the connector of the present invention prior to the connection of the plug component with the socket component.

Referring first more particularly to FIG. 1*a,* the connector arrangement 1 of the present invention includes a plug 2 that is arranged for axial connection with a socket 3 that is mounted within and opening contained in a fixed support 11, such as the housing of an electrical apparatus. The plug includes a cylindrical inner body portion 4 formed from a suitable electrically insulating synthetic plastic material, which body portion contains a plurality of through bores in which are respectively mounted a plurality of male pin contacts 2*a*. The plug also includes an integral tubular portion 4*a* that extends coaxially from one end of the plug body. The plug is provided with a cable protecting device 13 that surrounds and protects the conductors that extend from the cable 12 to the respective male contacts 2*a*.

The socket 3 is formed from a suitable electrically insulating synthetic plastic material and includes a central cylindrical portion 5 containing a plurality of through bores that respectively receive the female contacts 3*a*. The socket also includes an integral outer annular portion 8 arranged in concentrically spaced relation about the socket central portion, thereby to define a groove G for receiving the plug tubular portion 4*a* when the plug and socket components are connected, as will be described below. The inner circumference of the socket annular portion 8 is provided with internal screw threads 9 that extend a given distance b (FIG. 1*a*). An O-ring 14 formed from a compressible resilient synthetic plastic material is arranged concentrically adjacent the bottom wall of the groove G, thereby to define a resilient seat for the plug.

A tubular fastening sleeve 6 is mounted for rotation concentrically about the plug body portion 4, which sleeve has at one end a knurled or roughened operating knob portion 6*a*. At its other end, the sleeve is supported by an integral radially outwardly directed flange portion 4*b* formed at the extremity of the plug tubular portion 4*a*, as best shown in FIG. 1*b*. In accordance with a characterizing feature of the present invention, the sleeve 6 is provided on its outer circumferential surface with external screw threads 7 adapted for threaded engagement with the internal screw threads 9, the length "a" (FIG. 1*b*) of the external screw threads 7 being less than the length "b" of the internal screw threads 9. The external screw threads 7 are spaced from the end of the sleeve, thereby to define a smooth insertion surface 10*a* that is free from screw threads. Moreover, the number of the screw threads 7 is preferably from one to three, thereby to define adjacent the knob portion 6*a* a second circumferential surface 10*b* that is smooth and free from screw threads.

The internal and external screw threads 9 and 7 are rigid and non-resilient. The sleeve 6 and the outer annular socket portion 8 are preferably formed from a hard synthetic plastic material. Alternatively, the sleeve 6 could be formed of metal, and the socket 3 could be sectional and include a synthetic plastic cylindrical central section 5, and a metal annular outer section 8.

Operation

Assume that the movable plug 2 of FIG. 1 is to be connected with the stationary socket 3 that is non-rotationally mounted in an opening contained in the fixed support 11, thereby to electrically connect the conductors of cable 12 with the socket contacts 3*a*. The plug is axially displaced toward the socket to cause the end extremity 4*a* of the plug, together with the non-treaded end portion 10*a* of the sleeve 6, to be introduced into the annular groove G defined between the socket central body portion 5 and the annular outer socket portion 8.

Figure 2B:
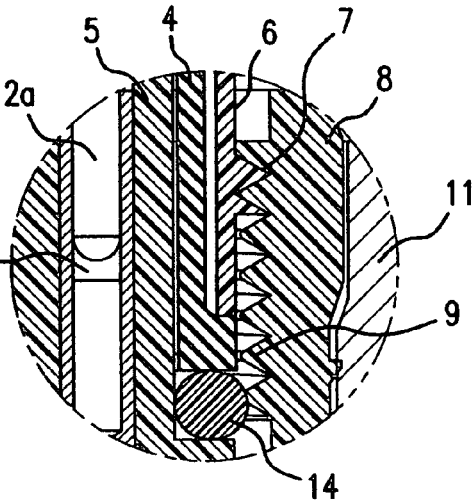
FIG. 2*b* is a detailed view of the connected components of FIG. 2*a.*
Figure 2A:
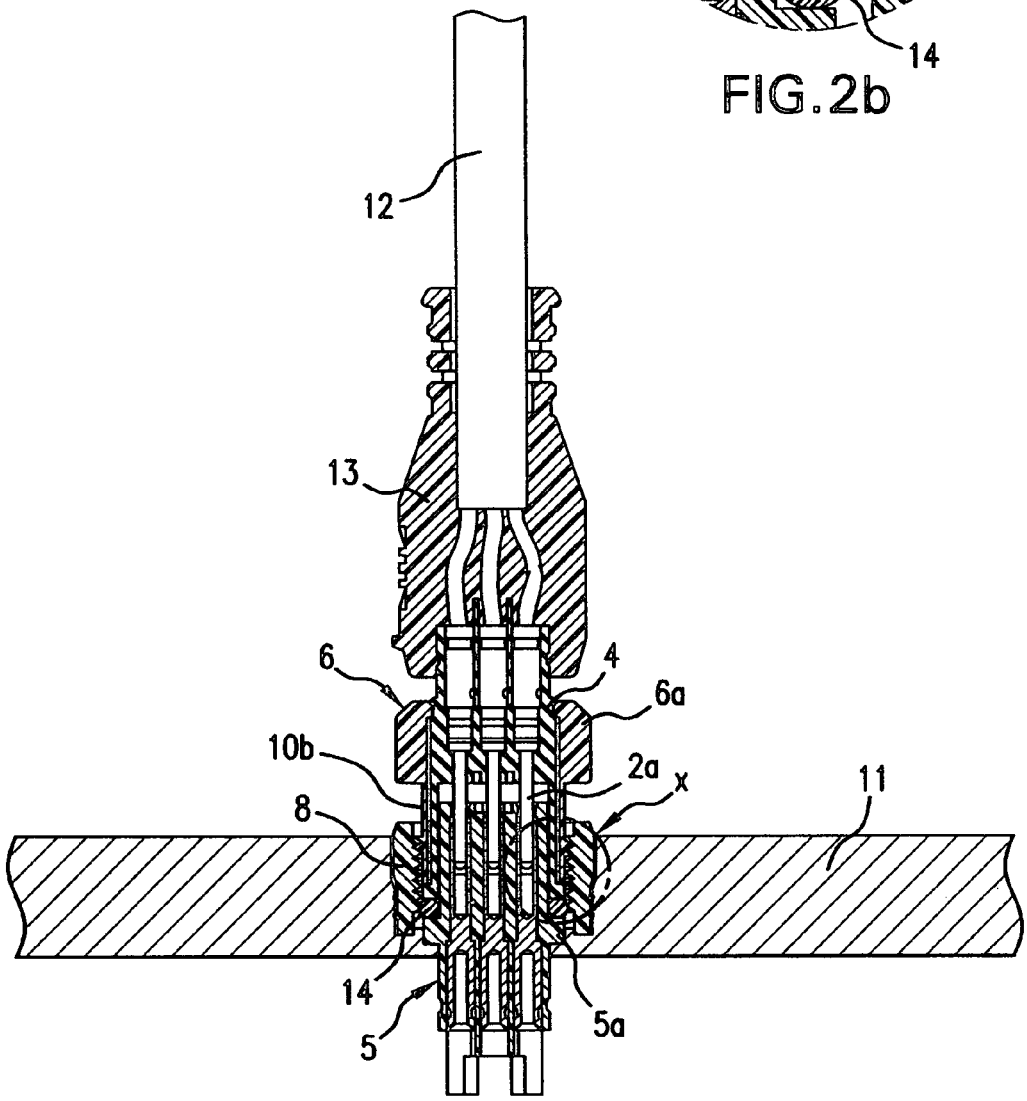
FIG. 2*a* is a sectional view illustrating the plug and socket components when in the electrically connected condition.

When the external threads 7 on the sleeve 6 engage the internal threads 9 on the outer socket portion 8, the sleeve 6 is rotated by means of its gripping portion 6*a*, thereby to effect threaded engagement between the external and internal screw threads. As shown in FIG. 2*a*, upon rotation of the sleeve 6 relative to the socket 3, the plug is displaced downwardly by the reaction between sleeve 6 and flange 4*b*, thereby to compress the O-ring 14 between the end surface of the flange portion 4*b* and the bottom wall of the annular groove G.

In accordance with an important advantage of the present invention, since the number of external screw threads 7 is less than the number of internal screw threads 9, only a few turns of the sleeve are required to fasten the plug to the socket.

As indicated above, the plug body 4 and the socket central body portion are formed from a suitable electrically insulating synthetic plastic material. The sleeve 6 and the annular outer socket section 8, may be formed from either metal or a hard synthetic plastic material.

Although the external threads 7 have been illustrated as having a smaller number and extending for a smaller length than the internal threads 9, it is apparent that this could be reversed so that in an alternate embodiment, the number and length of the external threads are less than the number and length of the of the internal threads. In this case, the internal screw threads on the socket outer portion would be spaced from the end of the outer socket portion adjacent the bottom of the groove G. In either case, the shorter screw length a is less than 30% and preferably less than 10%, of the larger thread length b. The sum of the shorter thread length a and the spacing distance c (FIG. 1*b*) is less than the longer thread length b (FIG. 1*a*).

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector, comprising:

(a) a socket component (3) adapted for non-rotatable collinear mounting in an opening contained in a fixed support (11), said socket component including:

(1) a cylindrical central body portion (5) formed of electrical insulating material and containing a plurality of longitudinal through bores;

(2) a plurality of electrical female contacts (3*a*) mounted in said socket through bores, respectively; and (3) an outer tubular portion (8) connected with and extending in concentrically spaced relation about said central body portion, thereby to define an annular groove (G);

(4) said outer tubular portion (8) having an internal surface carrying internal screw thread means (9);

(b) a cylindrical plug component (2) including:

(1) a cylindrical body portion (4) containing a plurality of plug through bores;

(2) said plug body portion having at one end an integral tubular end portion (4*a*) adapted to extend within said annular space; and (3) a plurality of male contacts (2*a*) supported within said plug bores, respectively, said male contacts being arranged for respective electrical engagement with said female contacts when said plug tubular end portion is inserted axially within said annular groove; and (c) a tubular fastening sleeve component (6) rotatably mounted concentrically about said plug component intermediate said plug component and said socket component outer tubular portion, said tubular sleeve component having an outer circumferential surface carrying external screw thread means (7) adapted for threaded engagement with said internal screw thread means;

(d) one of said internal and external screw thread means having a smaller number of screw threads and extending an axial length (a) that is less than about 30% of the axial length (b) of the other of said internal and external screw thread means, whereby following axial connection of the plug and socket components, the components may be fastened together by a relatively few turns of the sleeve component.

2. An electrical connector as defined in claim 1, wherein said one screw thread means has no greater than three thread turns.

3. An electrical connector as defined in claim 2, wherein said one screw thread means has no greater than two thread turns.

4. An electrical connector as defined in claim 1, wherein said one screw thread means is spaced from the extremity of the associated component by a given distance (c).

5. An electrical connector as defined in claim 1, wherein said one screw means has a thread pitch for connection with an M-standard component, thereby to permit connection to a standard M5, M6, M8 or M12 component.

6. An electrical connector as defined in claim 1, wherein said first and second screw thread means are rigid and non-resilient.

7. An electrical connector, comprising;

(a) a socket component (3) adapted for non-rotatable collinear mounting in an opening contained in a fixed support (11), said socket component including:

(1) a cylindrical central body portion (5) formed of electrical insulating material and containing a plurality of longitudinal through bores;

(2) a plurality of electrical female contacts (3*a*) mounted in said socket through bores, respectively; and (3) an outer tubular portion (8) connected with and extending in concentrically spaced relation about said central body portion, thereby to define an annular groove (G);

(4) said outer tubular portion (8) having an internal surface carrying internal screw thread means (9);

(b) a cylindrical plug component (2) including;

(1) a cylindrical body portion (4) containing a plurality of plug through bores;

(2) said plug body portion having at one end an integral tubular end portion (4*a*) adapted to extend within said annular space; and (3) a plurality of male contacts (2*a*) supported within said plug bores, respectively, said male contacts being arranged for respective electrical engagement with said female contacts when said clue tubular end portion is inserted axially within said annular groove; and (c) a tubular fastening sleeve component (6) rotatablv mounted concentrically about said plug component intermediate said plug component and said socket component outer tubular portion, said tubular sleeve component having an outer circumferential surface carrying external screw thread means (7) adapted for threaded engagement with said internal screw thread means;

(d) one of said internal and external screw thread means having a smaller number of screw threads and extending an axial length (a) that is less than about 30% of the axial length (b) of the other of said internal and external screw thread means, whereby following axial connection of the plug and socket components, the components may be fastened together by a relatively few turns of the sleeve component;

(e) said tubular end portion (4) of said plug component terminating at its free extremity in an outwardly directed flange portion (4*a*), said sleeve component being in abutting engagement with said plug component flange portion; and (f) a resilient O-ring (14) mounted in the bottom of said annular groove opposite the end surface of said plug flange portion, said O-ring being compressed between said plug flange portion and the groove bottom wall when said plug tubular portion is inserted within said groove.

8. An electrical connector as defined in claim 7, wherein said one screw thread means comprises said external thread means (7) on the outer surface of said sleeve component (6).

9. An electrical connector as defined in claim 8, wherein said one screw thread means (7) is spaced a given distance (c) from the insertion extremity of said plug flange portion, whereby the end portion (10*a*) of the outer surface of the sleeve component at the insertion end of the plug component is smooth and free from said one screw thread means.

* * * * *